US005465950A

United States Patent [19]

Takemoto et al.

[11] Patent Number: 5,465,950

[45] Date of Patent: Nov. 14, 1995

[54] PAPER SHEET CONVEYING AND ARRANGING APPARATUS

[75] Inventors: Takatoshi Takemoto; Kazunari Kawashima, both of Tokyo; Hideyuki Kadomatsu, Odawara; Moriyuki Aoyama, Okazaki; Takaharu Nakamura, Toyohashi, all of Japan

[73] Assignee: Kabushiki Kaisha Ace Denken, Tokyo, Japan

[21] Appl. No.: 167,948

[22] Filed: Dec. 20, 1993

[51] Int. Cl.[6] ..... B65H 3/52

[52] U.S. Cl. ..... 271/125; 271/225; 271/179; 271/184; 271/185; 271/314; 271/259; 235/91 R

[58] Field of Search ..... 271/225, 179, 271/184, 185, 314, 125, 258, 259; 235/91 R

[56] References Cited

U.S. PATENT DOCUMENTS

| | | | |
|---|---|---|---|
| 3,160,293 | 12/1964 | Hennequin | 271/179 |
| 4,699,262 | 10/1987 | Nakano et al. . | |

FOREIGN PATENT DOCUMENTS

| | | | |
|---|---|---|---|
| 119598 | 3/1983 | European Pat. Off. . | |
| 1225539 | 4/1967 | Germany . | |
| 37-18 | 1/1962 | Japan . | |
| 48-040158 | 6/1973 | Japan . | |
| 61-042696 | 9/1986 | Japan . | |
| 252868 | 10/1988 | Japan | 271/184 |
| 2-305736 | 12/1990 | Japan . | |
| 3-192053 | 8/1991 | Japan . | |
| 2234230 | 1/1991 | United Kingdom | 271/184 |

OTHER PUBLICATIONS

Patent Abstracts of Japan No. 63–252868.

*Primary Examiner*—H. Grant Skaggs
*Attorney, Agent, or Firm*—Lowe, Price, LeBlanc & Becker

[57] ABSTRACT

In a paper sheet conveying and arranging apparatus, a low-friction paper sheet guide member (18) is located in a parallel relationship to a paper sheet advancing direction, and a rotating spiral contact (19) having an axis inclined with respect to a horizontal plane toward an upstream side from the line perpendicular to the paper sheet advancing direction and passing on the upstream side of the paper sheet guide member (18), is rotated with a distal end (19*a*) frictionally contacting the surface of the paper sheet guide member (18) so as to move the paper sheet downwardly away from the one end of a conveyer. The paper sheet is thereby turned from a horizontal posture to a vertical posture by a minimal turning operation.

12 Claims, 4 Drawing Sheets

PAPER SHEET CONVEYING AND ARRANGING APPARATUS

FIELD OF THE INVENTION

This invention relates to a paper sheet conveying and arranging apparatus meant to be used with a conveyer which successively conveys paper sheets sideways in an upright posture. It is located adjacent to one end of the conveyer to let the successive paper sheets, which are inserted from the conveyer, fall after arranging them. This apparatus is used for collecting paper currency notes, for example.

BACKGROUND OF THE RELATED TECHNOLOGY

In a conventional paper sheet conveying system in which paper sheets supplied from a conveyer are finally properly arranged and stacked in a stacker, there is installed, as shown in FIG. 6, a contact 1, engageable with the supplied paper sheets for transferring them in a predetermined direction, to a shaft 2 perpendicular to a paper sheet advancing direction A.

However, since the contact 1 extends perpendicularly to the paper sheet advancing direction A, the distal end of the contact 1 acts at a point a in FIG. 6 so as to urge a paper sheet M downwardly and acts at a point b, on the contrary, so as to flap a paper sheet M upwardly, thus causing complicated movements of the paper sheets M. Therefore the original intended operation of the apparatus, i.e., letting paper sheets M, which have been inserted in a horizontal posture, fall into a vertical posture is difficult to achieve.

SUMMARY OF THE INVENTION

With the foregoing problem of the conventional art in mind, it is an object of this invention to provide a paper sheet conveying and arranging apparatus in which paper sheets inserted in a horizontal posture can be discharged so as to fall into a vertical posture reliably and without difficulty.

According to one aspect of this invention, the above object can be accomplished by a paper sheet conveying and arranging apparatus adapted to be used with a conveyer which moves a paper sheet in an upright posture , i.e. not flat, in the direction of its length and adapted to be located adjacent to one end of the conveyer for properly arranging the paper sheets, which are received from the conveyer, and allowing the paper sheets to be conveyed in a proper arrangement, the apparatus comprising: a low-friction guide member adapted to be located adjacent to the end of the conveyer, from which the paper sheets are successively conveyed, the guide member being disposed to have a surface in a parallel relationship to a paper sheet advancing direction; and a spiral contact having an axis of spiral inclined with respect to a horizontal plane toward the upstream side from the line perpendicular to the paper sheet advancing direction and passing on the upstream side of the guide member, the contact being adapted to be driven for rotation, with its distal end frictionally contacting the surface of the guide member, so as to move the paper sheet downwardly away from the one end of the conveyer.

In operation, paper sheets are conveyed in a horizontal posture by a conveyer to arrive at an inlet of the paper sheet conveying and arranging apparatus.

Paper sheets, which have been conveyed while they partially overlap one another, are brought to a guide member by the action of a spiral contact and are then advanced in contact with the surface of the guide member.

Partly since the spiral contact has an axis of spiral inclined with respect to a horizontal plane toward the upstream side from the line perpendicular to the paper sheet advancing direction and partly since the distal end of the spiral contact is frictionally engageable with the surface of the paper sheet guide member, the distal end of the spiral contact reliably turns the horizontal paper sheets into a vertical posture to move them downwardly, without causing complicated movements of paper sheets, such as pressing a paper sheet beyond the plane including the surface of the guide member before the paper sheet arrives at the guide member and contacting the trailing end of the paper sheet to cause the paper sheet to flap upwards after the leading end of the paper sheet arrives at the guide member.

In this paper sheet conveying and arranging apparatus, partly since the low-friction guide member is located parallel to the paper sheet advancing direction and partly since the spiral contact has an axis of spiral inclined with respect to a horizontal plane toward the upstream side from the line perpendicular to the paper sheet advancing direction, the distal end of the spiral contact frictionally engages the surface of the guide member so as to bring a paper sheet away from the end of the conveyer and turn it so that it falls. As a result, the paper sheet is turned from a horizontal posture into a vertical posture by a minimal turning operation and is hence not subjected to any unnecessarily large turn which might, for example, cause the paper sheet to be easily folded back on itself.

DETAILED DESCRIPTION OF THE PREFERRED EMBODIMENT

The preferred embodiment of this invention will now be described with reference to the accompanying drawings.

Figure 1:
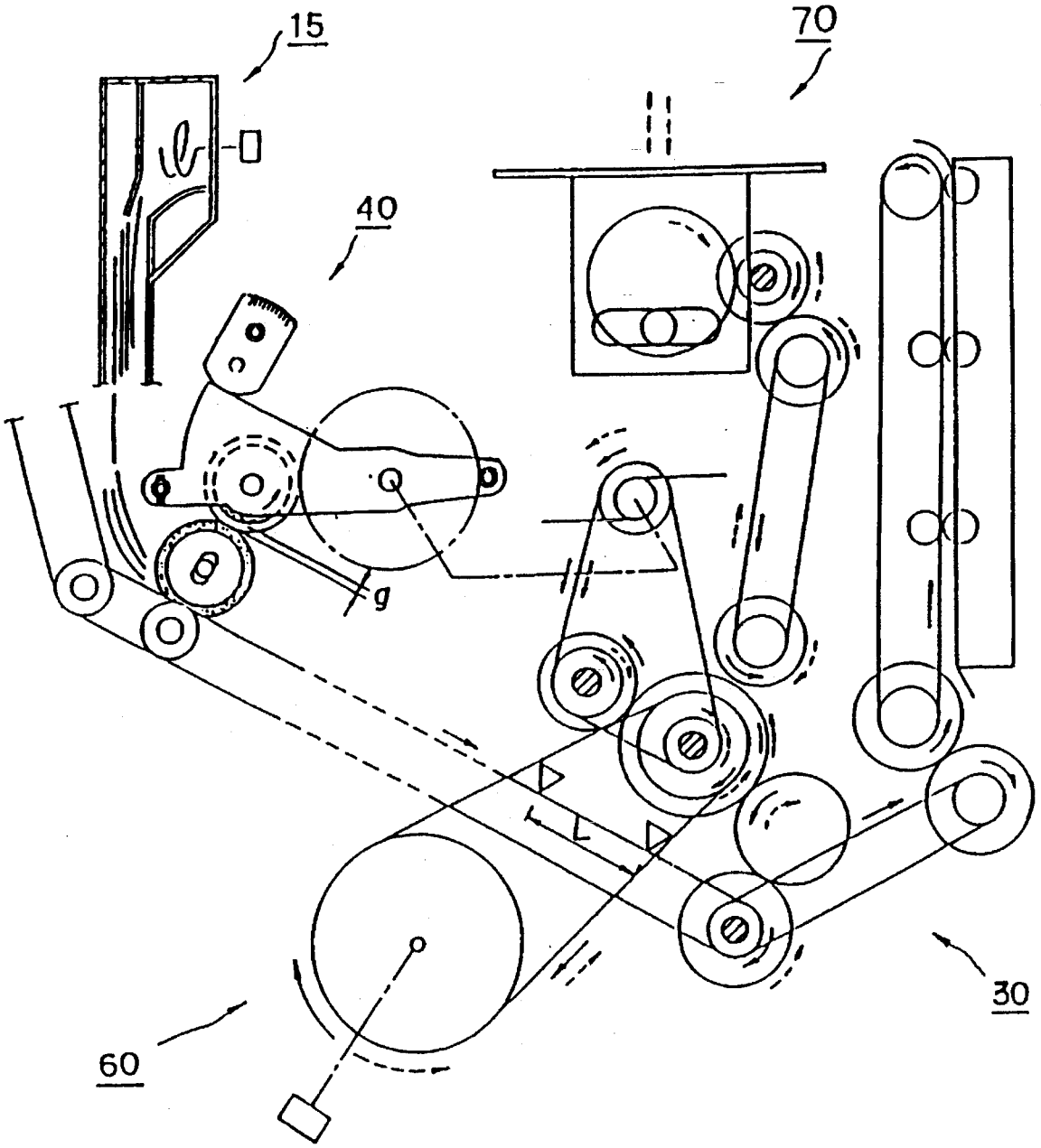
FIG. 1 is a schematic view showing a paper sheet conveying system in which a paper sheet conveying and arranging apparatus of this invention is incorporated.

FIG. 1 shows a paper sheet conveying system to which a paper sheet conveying and arranging apparatus of the invention is applied. This system comprises an upper conveying unit 30, a receiving unit 15 for receiving paper sheets, which are inserted from individual non-illustrated terminals, and discharging them to the conveying unit downstream, a separating unit 40 disposed adjacent to an inlet of the conveying unit 30, a stacking unit 70 from which the paper sheets piled neatly are to be taken out, and a drive unit 60.

Figure 2:
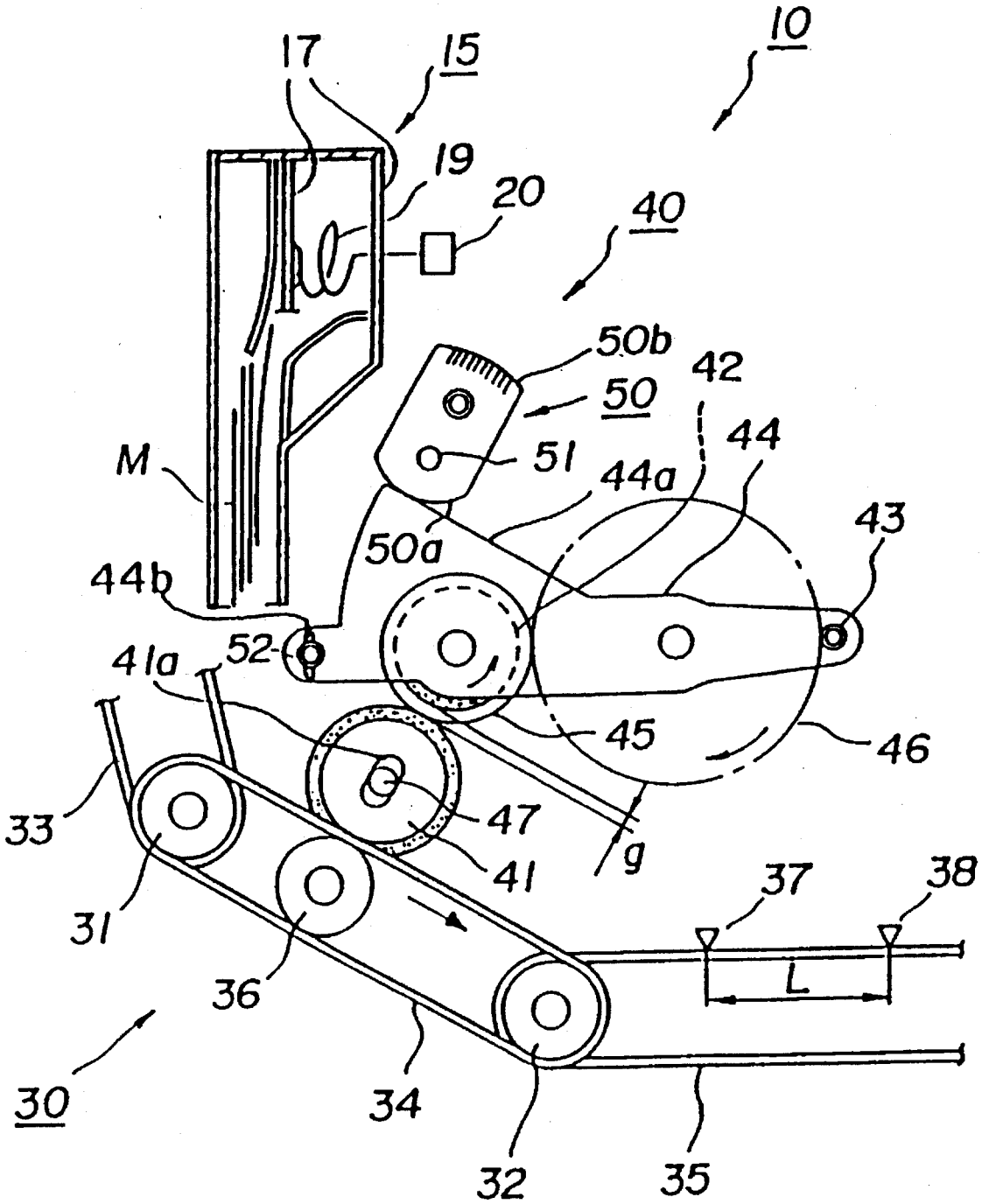
FIG. 2 is a schematic view showing the structure of a paper sheet conveying and arranging apparatus.
Figure 5:
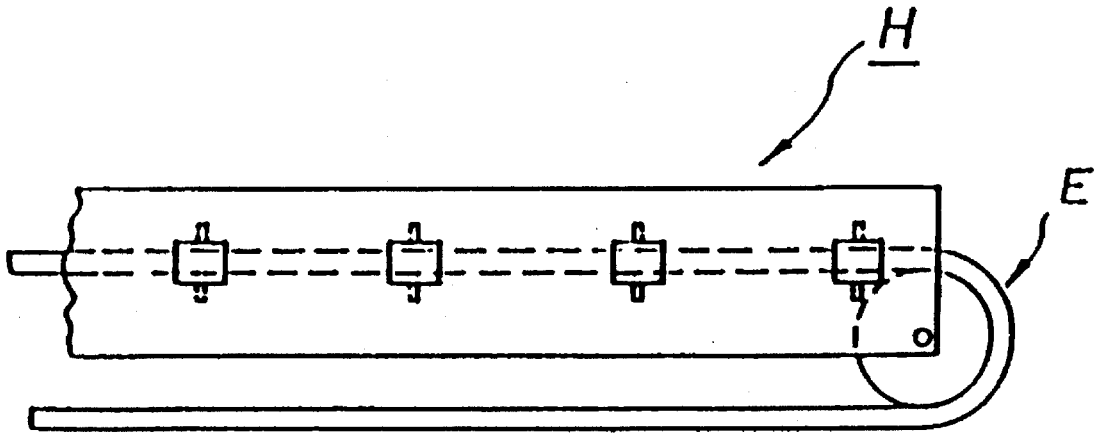
FIG. 5 is a front view of a conveyer.
Figure 6:
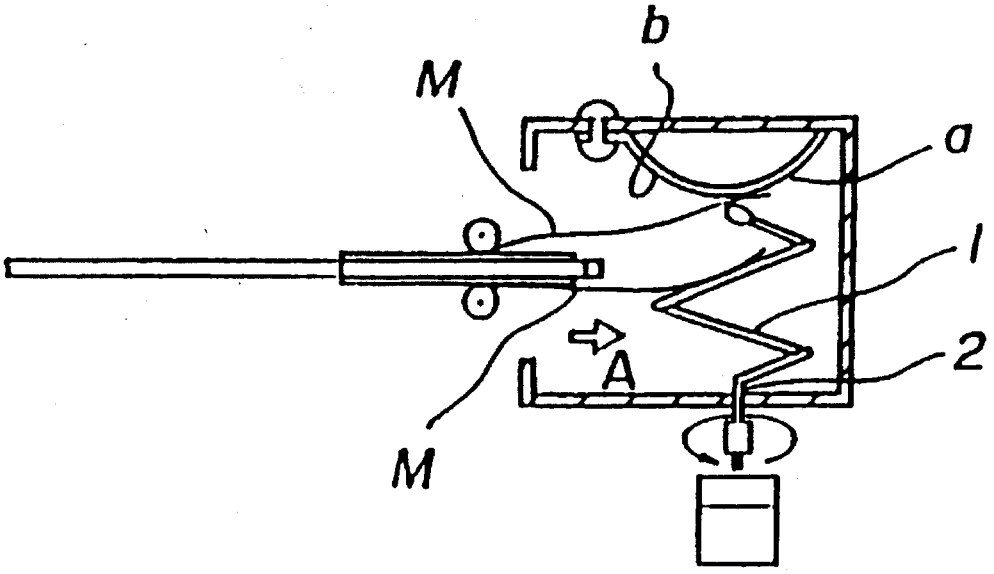
FIG. 6 (PRIOR ART)
FIG. 6 is a cross-sectional view of a collecting and dispensing unit of a conventional apparatus.

The paper sheet conveying and arranging apparatus 10, as shown in FIG. 2, comprises a paper sheet receiving unit or a collecting and dispensing unit 15 to which paper sheets are to be conveyed from individual non-illustrated terminals by a conveyer H of FIG. 5, the conveying unit 30 for conveying paper sheets by conveyer belts, and the separating unit 40 for separating successive paper sheets from one another.

Figure 3:
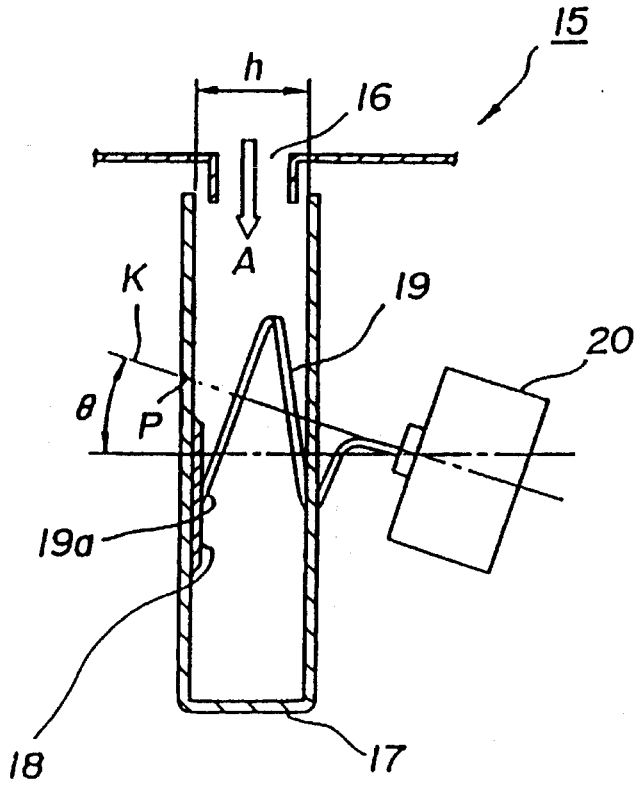
FIG. 3 is a cross-sectional view of a collecting and dispensing unit of the embodiment.

The collecting and dispensing unit 15, as best seen in FIG. 3, has an inlet 16 for receiving sheets from one end E of the conveyer H, which conveys the paper sheets from the individual terminals of FIG. 5, and also has a small-width dispensing unit cover 17 for receiving the introduced paper sheets.

The width h of the dispensing unit cover 17 is sufficiently small to prevent the received paper sheets from being curled or folded.

On the cover 17 at one surface parallel to a paper sheet advancing direction A, a paper sheet guide member 18 for guiding paper sheets is mounted as shown in FIG. 3. The paper sheet guide member 18 is made of a low-friction material such as synthetic resin.

From the cover's wall opposite to the paper sheet guide member 18, a spiral contact 19 extends to shake down paper sheets.

The spiral contact 19 is driven by a driving motor 20 and has an axis K of spiral inclined with respect to a horizontal plane toward the upstream side from the line perpendicular to the paper sheet advancing direction A by an angle θ. The value of θ may be selected optionally, for example, according to the number of windings of the spiral, and is 12 degrees in the illustrated embodiment. Preferably it should be selected in such a manner that the spiral contact can adequately receive the inserted paper sheets.

Figure 4:
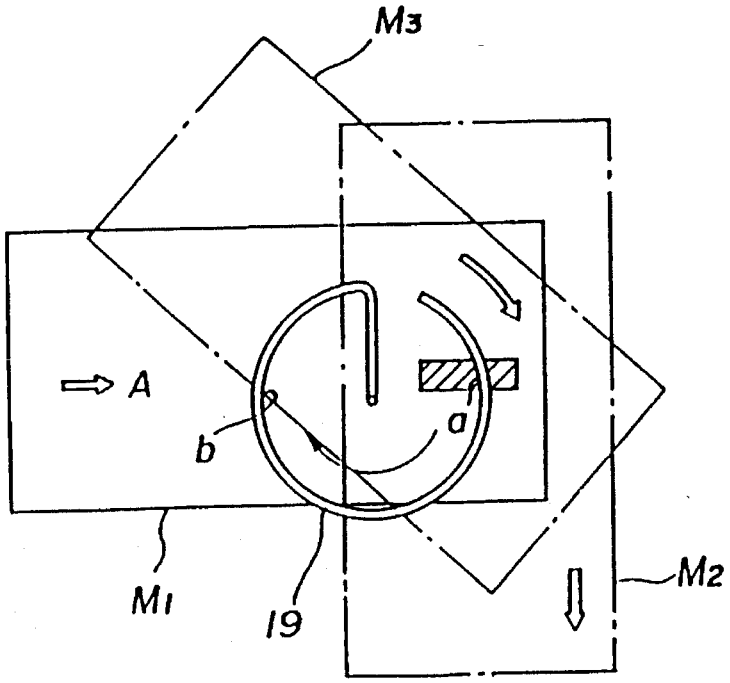
FIG. 4 is a diagram showing how the collecting and dispensing unit operates.

A point P at which the axis K crosses the cover's wall on which the paper sheet guide member 18 is mounted is disposed upstream of the guide member 18. As shown in FIG. 4, when the distal end 19*a* of the contact 19 is located in such a phase as to shake down paper sheets, it comes into contact with the paper sheet guide member 18.

The conveying unit 30 includes, as shown in FIG. 2, a plurality of pulleys 31, 32 and a plurality of conveyer belts 33, 34, 35 wound on the pulleys 31, 32 and is driven, upon receipt of power from a non-illustrated drive means, to convey paper sheets to the right in FIG. 2.

A support roller 36 is disposed in confronting relationship with a below-described separator roller 41, as shown in FIG. 2.

At a midportion of the conveyer belt 35, first and second sensors 37, 38 are located, with a space L in between them, for counting the number of separated paper sheets.

The distance L is slightly larger than the length of a single paper sheet and smaller than the total length of two paper sheets.

Coaxially connected with a drive roller 42 of the separating unit 40 is a gear 45 meshing with a gear 46 for transmitting a one-way rotating force by the non-illustrated drive means.

There is defined between the separator roller 41 and the drive roller 42 a very small predetermined gap g, which is larger than the thickness of a single paper sheet and smaller than the total thickness of two paper sheets.

The separator roller 41 has an elongated axial hole 41*a* so that the separator roller 41 is movable within the predetermined gap g about a pivot 47 to come into contact with either the conveyer belt 34 or the drive roller 42, but only one at a time.

There is provided a setting cam plate 50 serving as a means for adjustably setting the predetermined gap g.

The setting cam plate 50 is angularly movable about a cam axis 51 and has a cam surface 50*a* which moves down pressing against a contact surface 44*a* of a support arm 44. One end of the support arm 44 is normally energized upwardly in FIG. 2 by a non-illustrated energizing means, and in the other end, symmetric with a pivot 43, an elongated hole 44*b* is provided, through which a small screw 52 is fitted for fastening.

The setting cam plate 50 has a series of markings 50*b* for reading the value of the setting.

The operation of this apparatus will now be described.

Successive paper sheets partially overlap one another as they are conveyed. The paper sheets are brought to the paper sheet guide member 18 by the action of the spiral contact 19 and are then discharged downwardly by the distal end 19*a* of the contact 19 in contact with the surface of the paper sheet guide member 18.

Assuming that the contact 19 is turned clockwise in FIG. 4, since the axis K of spiral of the contact 19 is inclined toward the upstream side by an angle 0 as shown in FIG. 3, the distal end 19*a* of the contact 19 comes into contact with a paper sheet only in the phase of the paper sheet guide member 18 so that the paper sheet inserted in a direction A in a horizontal posture $M_1$ will be turned into a vertical posture $M_2$ by a minimal turn. If there was no inclination and the axis K of the contact 19 was perpendicular to the paper sheet advancing direction A, the contact 19 would have contacted the paper sheet not only at a point "a" in FIG. 4 but also at a point "b" where the paper sheet would have been caused to flap up, thus resulting in a large turning motion of the paper sheet as indicated by $M_3$. This large turn would have caused the paper sheet to unfavorably knock on the wall of the cover and once again giving it the tendency to become curled or folded.

In the separating unit 40, the drive roller 42 is coaxially connected with the gear 45 meshing with the gear 46, which is operatively connected to the non-illustrated drive means for rotation in one direction. Thus the drive roller 42 is at all times rotating counterclockwise in FIG. 2.

Then when a single paper sheet is inserted under the separator roller 41, the separator roller 41 will be raised to an extent corresponding to the thickness of a single paper sheet. At that time, because the predetermined gap "g" between the separator roller 41 and the drive roller 42 is larger than the thickness of a single paper sheet, these two rollers 41, 42 will not come into contact with one another and so will continue to convey the paper sheet to the downstream side by the conveyer belt 46.

If two or more paper sheets are inserted, the separator roller 41 will come into contact with the drive roller 42 to rotate clockwise as shown in FIG. 2, because the predetermined gap "g" is smaller than the thickness of two sheets of paper. Then the upper paper sheet contacting the separator roller 41 will be pushed back upstream, while only the first i.e., lower paper sheet contacting the conveyer belt 46 will be conveyed downstream.

The first and second sensors 37, 38 located in the conveying path count the number of separated paper sheets, discriminating whether or not any multi-sheet conveying has occured.

Although the present invention has been described and illustrated in detail, it should be clearly understood that the same is by way of illustration and example only and is not to be taken by way of limitation, the spirit and scope of the present invention being limited only by the terms of the appended claims.

We claim:

1. A paper sheet conveying and arranging apparatus to be used with a conveyer which successively conveys paper sheets sideways in an upright posture, to be located adjacent to one end of the conveyer for properly arranging the successive paper sheets which are received in a partially overlapping relationship from the conveyer, and for letting the received paper sheets fall into a proper arrangement, comprising:

a low-friction paper sheet guide member located adjacent to said one end of the conveyer from which the paper sheets are successively received, the guide member being disposed to have a surface in a parallel relationship to a paper sheet advancing direction; and a spiral contact having an axis of rotation which is inclined at an angle θ with respect to a horizontal plane toward an upstream side from a line perpendicular to the paper sheet advancing direction and passing on the upstream side of said guide member, said spiral contact being rotatable so that a distal end of the spiral contact is frictionally engageable with said surface of said guide member and so as to contact and move the successively received paper sheets downwardly away from said one end of the conveyer.

2. The apparatus according to claim 1, wherein:

said angle θ is 12°.

3. The apparatus according to claim 1, further including:

a conveying unit cooperating with the rotating spiral contact to receive said paper sheets moved downwardly relative to said one end of the conveyor and to convey them further.

4. The apparatus according to claim 3, wherein:

said conveying unit comprises separator means for separating the paper sheets to ensure that the paper sheets are individually separated from each other as they are conveyed further.

5. The apparatus according to claim 4, wherein:

the separator means comprises a separator roller and a drive roller spaced apart by an adjustable gap "g" which is selected to be larger than the thickness of one of the paper sheets but smaller than two of the paper sheets, the separator roller being movable with the gap "g" to contact only one of the drive roller or a conveyor belt conveying said paper sheets away from said rotating spiral contact.

6. The apparatus according to claim 5, further comprising:

gap adjustment means for enabling controlled adjustment of gap "g".

7. The apparatus according to claim 6, further comprising:

paper sheet counting means cooperating with said conveying unit for counting a number of said paper sheets conveyed further thereby.

8. The apparatus according to claim 7, wherein:

said distal end of said rotating spiral contact makes contact with one of said paper sheets only when engageable with said surface of said guide member.

9. The apparatus according to claim 8, wherein:

said angle θ is selected so as that contact by the distal end of the rotating spiral contact is sufficient only to rotate each paper sheet from a horizontal posture to a vertical posture.

10. The apparatus according to claim 3, further comprising:

paper sheet counting means cooperating with said conveying unit for counting a number of said paper sheets conveyed further thereby.

11. The apparatus according to claim 1, wherein:

said distal end of said rotating spiral contact makes contact with one of said paper sheets only when engageable with said surface of said guide member.

12. The apparatus according to claim 1, wherein:

said angle θ is selected so that contact by the distal end of the rotating spiral contact is sufficient only to rotate each paper sheet from a horizontal posture to a vertical posture.

* * * * *

UNITED STATES PATENT AND TRADEMARK OFFICE

CERTIFICATE OF CORRECTION

PATENT NO. : 5,465,950

DATED : November 14, 1995

INVENTOR(S) : Takatoshi TAKEMOTO et al.

It is certified that error appears in the above-indentified patent and that said Letters Patent is hereby corrected as shown below:

On the title page, after item [21] please insert the following:

--[22] PCT Filed: June 26, 1991

PCT No.: PCT/JP91/00863

371 Date: Dec. 20, 1993

102(e) Date: Dec. 20, 1993

[87] PCT Pub. No.: WO93/00284

PCT Pub. Date: Jan. 1, 1993--

Signed and Sealed this

Seventeenth Day of September, 1996

Attest:

Bruce Lehman

BRUCE LEHMAN

Attesting Officer

Commissioner of Patents and Trademarks